US005417495A

United States Patent [19]

Branson

[11] Patent Number: 5,417,495

[45] Date of Patent: May 23, 1995

[54] RECLOSABLE BAG

[75] Inventor: Mark E. Branson, Morristown, Ind.

[73] Assignee: KCL Corporation, Shelbyville, Ind.

[21] Appl. No.: 236,542

[22] Filed: May 2, 1994

[51] Int. Cl.[6] ..... B65D 33/16

[52] U.S. Cl. ..... 383/63; 383/5; 383/9; 383/84

[58] Field of Search ..... 383/63, 65, 78, 81, 383/84, 86, 5, 9

[56] References Cited

U.S. PATENT DOCUMENTS

| | | | |
|---|---|---|---|
| Re. 34,554 | 3/1994 | Ausnit | 383/63 |
| 2,772,712 | 12/1956 | Post . | |
| 3,619,395 | 11/1971 | Skendzic . | |
| 4,112,541 | 9/1978 | Tetradis . | |
| 4,509,196 | 4/1985 | Sak et al. . | |
| 4,703,518 | 10/1987 | Ausnit . | |
| 4,785,940 | 11/1988 | Wilson . | |
| 4,787,754 | 11/1988 | Herrington . | |
| 4,787,755 | 11/1988 | Branson . | |
| 4,807,300 | 2/1989 | Ausnit . | |
| 4,834,552 | 5/1989 | Makowka . | |
| 4,846,586 | 7/1989 | Bruno | 383/65 X |
| 4,874,257 | 10/1989 | Inagaki | 383/63 |
| 5,007,744 | 4/1991 | Scarberry et al. . | |
| 5,056,930 | 10/1991 | Mestetsky . | |
| 5,135,313 | 8/1992 | Bowman . | |
| 5,205,649 | 4/1993 | Fullerton . | |

FOREIGN PATENT DOCUMENTS

| | | | |
|---|---|---|---|
| 90167 | 5/1958 | Denmark . | |
| 1523206 | 5/1968 | France | 383/65 |
| 2332191 | 6/1977 | France | 383/63 |
| 226556 | 9/1989 | Japan | 383/63 |
| 99011 | 11/1961 | Netherlands | 383/63 |

*Primary Examiner*—Allan N. Shoap
*Assistant Examiner*—Jes F. Ascua
*Attorney, Agent, or Firm*—Woodard, Emhardt, Naughton, Moriarty & McNett

[57] ABSTRACT

A reclosable bag is disclosed wherein a fastener strip has male and female cooperating profiles mounted thereon. The fastener strip is mounted on the inside surface of the rear panel of the bag with one of the profiles in the bag. The fastener strip is foldable over the front panel of the bag to a position wherein the male and female profiles cooperate to close the bag with the front panel between the profiles.

6 Claims, 4 Drawing Sheets

RECLOSABLE BAG

BACKGROUND OF THE INVENTION

This invention relates to a reclosable bag.

One of the problems involved in the manufacture of reclosable bags involves the accuracy required to locate the male and female profiles on the bag so that they function properly when the bag is closed. The desired attributes are that the bag opens and closes easily from the outside and also has enough resistance to contain the contents properly inside the bag. In some situations it has been found that 20 to 25% of the bags manufactured must be scrapped because the male and female profiles are not accurately located relative to one another. An improved reclosable bag is needed which avoids such a problem.

Reclosable bags are normally manufactured with the bag in a closed condition. Frequently there are situations where the user or consumer of the bags would prefer to receive the bags from the manufacturer in an open condition. If the manufacturer or supplier of the bags is to supply them in an open condition, an additional step of opening tile bags must be accomplished thus requiring additional cost. One example of a bag preferably supplied in an open condition is the bag used in the produce section of a grocery store. Another example is the bag used in a delicatessen. Such bags might be hung for example on a wicket. When the user of the bags grabs them, it is preferable that they be open so that he does not have to use both hands to open them. Thus the item can be placed directly in the bag without first having to open it.

An improved reclosable bag is needed which is manufactured in an open condition.

There is disclosed in certain patents such as my U.S. Pat. No. 4,787,755 and the Ausnit U.S. Pat. No. 4,707,518 a reclosable bag in which the profiles close the bag with the film of the front panel and the rear panel between the profiles. Such a closure may not work properly if the film used for the front panel and the rear panel is relatively thick. It is desirable that an improved reclosable bag be provided that can close properly even though the film is thicker than that which can be used in the bags of U.S. Pat. Nos. 4,787,755 and 4,707,518.

Other patents besides the Branson and Ausnit patents mentioned above which may have some relevance to the present invention are U.S. Pat. Nos. 2,772,712 to Post, 3,619,395 to Skendzic, 4,509,516 to Sak, 4,785,940 to Wilson, 4,834,552 to Makowka, 5,007,744 to Scarberry, 5,056,930 to Mestetsky, 5,135,313 to Bowman, 5,205,649 to Fullerton as well as Danish patent 90,167 to Holger Emil Boggesgaard and Norwegian patent 98,922 to Kristen Sundby.

SUMMARY OF THE INVENTION

One embodiment of the present invention might include a reclosable bag having a front panel and a back panel. The back panel has an inside surface which faces towards the front panel. A fastener strip is provided which is mounted on the inside surface of the back panel and which has a first and a second profile mounted on it in spaced relation. The fastener strip is foldable over the front panel to a position wherein the first profile cooperates with the second profile to close the bag with the front panel between the first and second profiles.

DESCRIPTION OF THE PREFERRED EMBODIMENT

Figure 2:
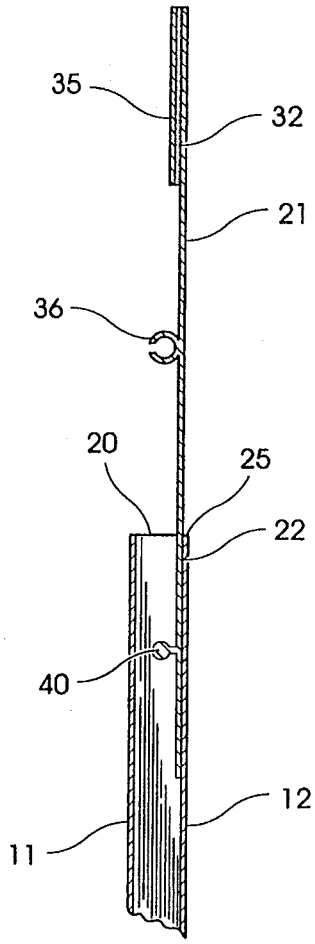
FIG. 2 is an enlarged section taken along the line 2—2 of FIG. 1 in the direction of the arrows.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
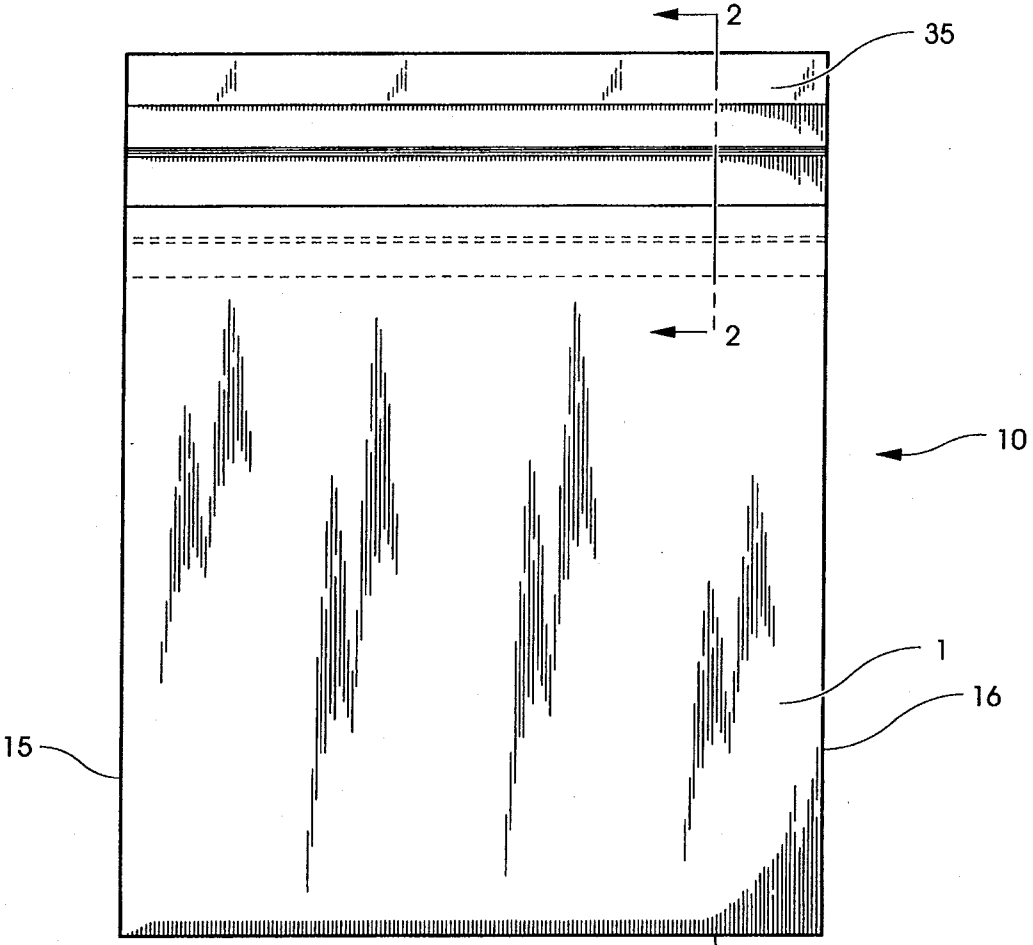
FIG. 1 is a front perspective view of a flexible reclosable plastic bag embodying the present invention.
Figure 3:
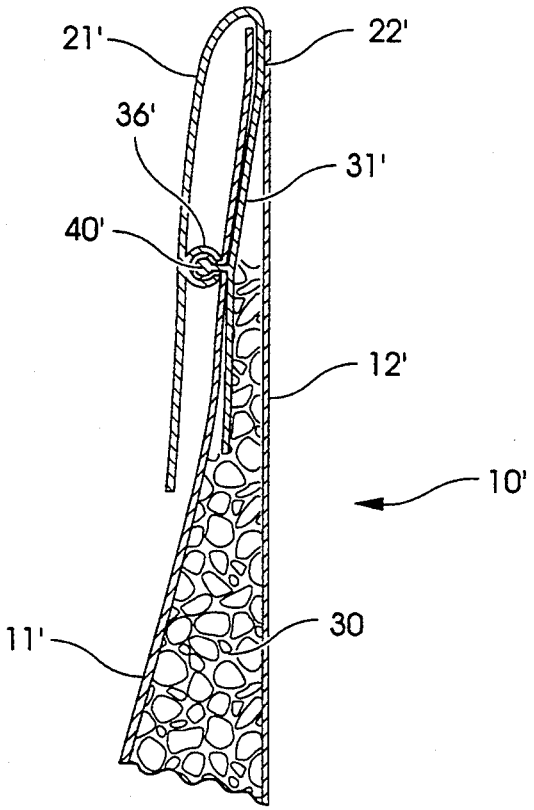
FIG. 3 is a section similar to FIG. 2 of an alternative embodiment of the invention and also showing the bag in a closed condition with objects in the bag.

Referring to FIGS. 1 and 2, there is illustrated a reclosable bag 10 which includes a transparent front panel 11 and a transparent rear panel 12. The transparent bag 10 is closed at its three edges 15, 16 and 17 but is open at 20. The bag of FIGS. 1 and 2 is tamper evident. That is, it includes a fastener strip 21 fixedly mounted on the rear panel 12 of the bag 10 which is used to provide a tamper evident closure. This fixed mounting is at the area 22 which is very near to the upper edge 25 of the back panel 12. The fastener strip 21 is not fixed to the bag at the lower end of the fastener strip in order to allow objects to move into the space between the fastener strip 21 and the rear panel 12 when there are objects in the bag. Referring to FIG. 3, objects 30 are shown in the bag 10' between the lower portion 31' of the fastener strip 21' and the rear panel 12' of an alternative form of the invention. The embodiment of FIGS. 1 and 2 functions with regard to objects inside of the bag in the same fashion as the bag illustrated in FIG. 3.

Referring again to FIGS. 1 and 2, as mentioned above, the embodiment shown therein has a tamper evident feature. The fastener strip 21 has adhesive 32 applied to its upper end, this adhesive being covered by a release liner 35. Thus the bag of FIGS. 1 and 2 may be closed by removing the release liner 35 and adhering the adhesive 32 to the front panel 11. The bag of FIGS. 1 and 2 also has reclosability, however, which is provided by the female profile 36 and the male profile 40. Thus after the tamper evident closure provided by the adhesive 32 has been opened reclosability is provided by causing the female profile 36 to be pressed against the front panel 11 causing the profiles 36 and 40 to mate with the front panel 11 between the profiles. This relationship is shown in FIG. 3 for the alternative embodiment wherein the profiles 36' and 40' have the front panel 11' received between them. The embodiment of FIGS. 1 and 2 may be reclosably closed in exactly the same fashion as the embodiment of FIG. 3 after the tamper evident closure has been opened.

Figure 4:
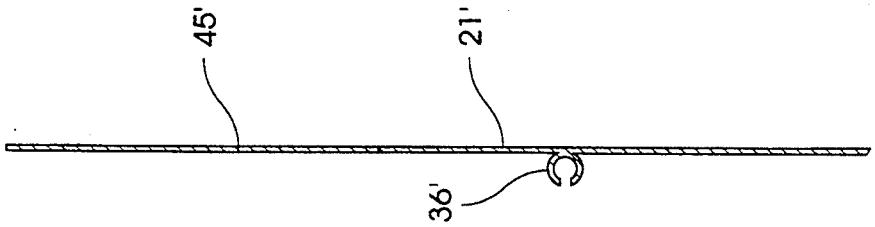
FIG. 4 is a sectional view similar to FIG. 2 of the embodiment of FIG. 3 but showing the bag open and with a receipt still attached.
Figure 5:
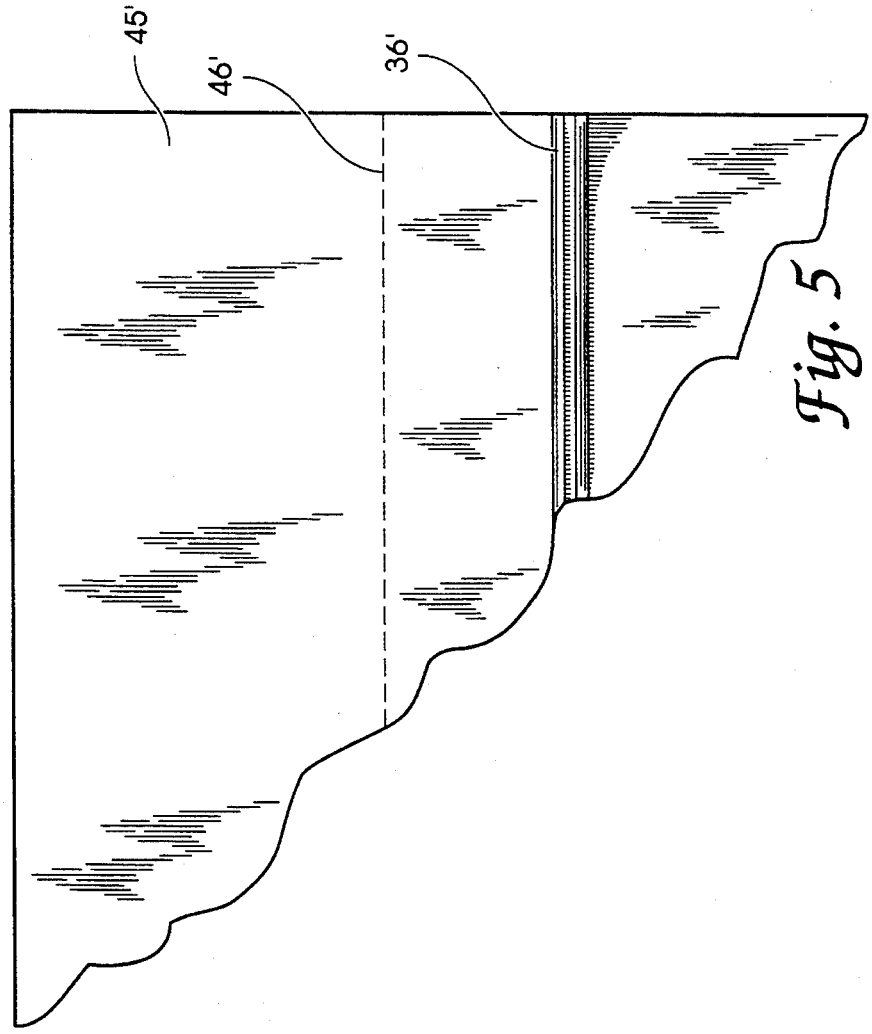
FIG. 5 is a front elevation of the structure of FIG. 4.

Referring to FIGS. 4 and 5 the embodiment of FIG. 3 is further shown but in a different operating position than FIG. 3. In FIGS. 4 and 5 the embodiment is shown as having a receipt 45′ at its upper end which receipt extends from the fastener strip 21′. The receipt 45′ is separated or may be separated from the fastener strip 21′ by means of the perforations 46′. As explained above, FIG. 3 shows the embodiment of FIGS. 4 and 5 in a closed condition with the objects inside of the container separating the rear panel 12′ from the fastener strip lower portion 31′. Similarly to the embodiment of FIGS. 1 and 2 the fastener strip 21′ is attached to the rear panel 12′ along the line 22′ so that the objects 30 within the bag do not tug and pull at the profiles as they would do if they lower portion 31′ was adhered to the rear panel 12′ at the lower end of the lower portion 31′.

Figure 7:
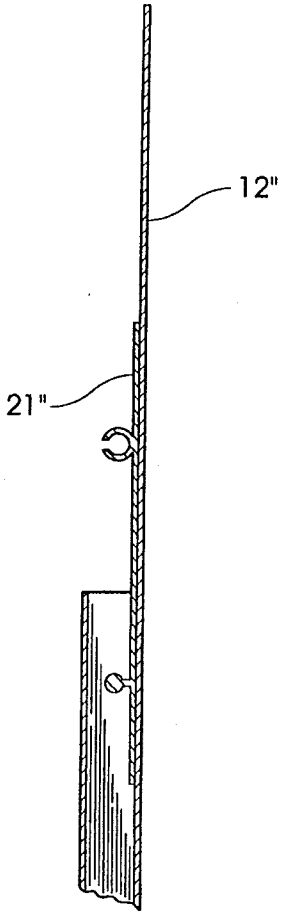
FIG. 7 is an enlarged section taken along the line 7—7 of FIG. 6 in the direction of the arrows.
Figure 6:
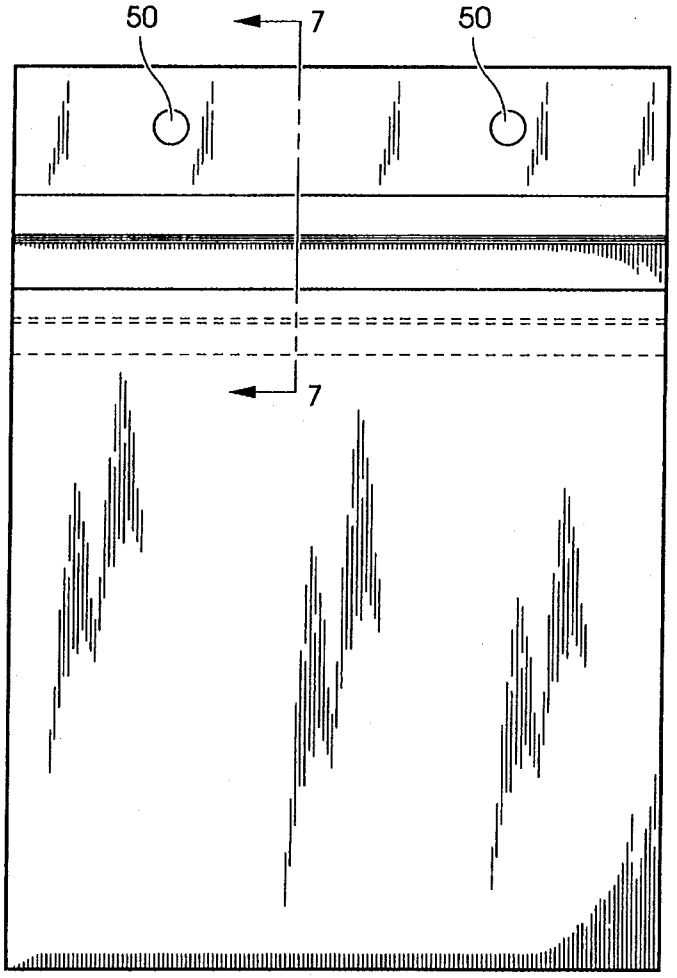
FIG. 6 is a front elevation similar to FIG. 1 of still another alternative embodiment of the invention.

Referring to FIGS. 6 and 7, a further alternative embodiment of the invention is illustrated which is substantially the same in construction and operation as the embodiments above described with the exception that the embodiment of FIGS. 6 and 7 does not have a receipt section and does not have a tamper evident adhesive type closure. Instead the embodiment of FIGS. 6 and 7 has an extended back panel 12″ which has two holes 50 in it that are used to hang the bag on a wicket. Thus the bag of FIGS. 6 and 7 can be used in a deli or produce section of a grocery store and it will be hung on the wicket in an open condition so that the user of the bag does not need to open it before placing the objects in the bag. The bag of FIGS. 6 and 7 is reclosably closed in the same fashion as shown in FIG. 3.

It is contemplated that each of the fastener strips 21, 21′ and 21″ be extruded as a single extrusion with its male and female profile as an integral part of that extrusion. It will be evident from the above description that the present invention provides a bag design which will not require substantial scrap as in the prior art because it does not require that the male and female profiles be accurately positioned relative to one another on the film during manufacture. Instead the position of the male and female profiles is determined during the extrusion operation of the fastener strip. Furthermore their spacing is not critical to the operation of the bag because the fastener strip acts as the bag closure.

It will also be evident that the reclosable bag of the present invention makes possible supplying the bags in an open condition because that is how the bags are manufactured. Thus the fastener strip is secured inside the open upper end of the bag.

It will also be evident that the present invention permits closure of the bag with the placing of only a single layer of film between the male and female profiles. Thus the thickness of the film can be greater and still produce an effective closure than would be the case where two thicknesses of film are required.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A reclosable bag comprising:

a front panel having bottom, top and side edges; a back panel having bottom, top and side edges; said front panel and back panel being joined at their bottom and side edges and being open at their top edges, said back panel having an inside surface facing toward said front panel;

a fastener strip mounted on said inside surface of said back panel, said fastener strip having a first profile and a second profile adapted to cooperate with one another for closure, said fastener strip being foldable over said front panel to a position wherein said first profile cooperates with said second profile to close the bag with the front panel between the first and second profiles.

2. A reclosable bag as defined in claim 1 wherein said fastener strip is attached to said back panel immediately adjacent to said top edge of said back panel and said fastener strip extends into said bag from said attachment, said first profile and said second profile being spaced on opposite sides of said attachment whereby objects placed in the bag do not tug and pull at the profiles when said bag is closed.

3. A reclosable bag as defined in claim 1 wherein said fastener strip includes a tamper evident sealing portion which extends away from said bag outboard of said first and second profiles, said sealing portion having adhesive thereon permitting said sealing portion to be attached to said bag by said adhesive.

4. A reclosable bag as defined in claim 1 wherein said fastener strip includes a receipt portion which extends away from said bag outboard of said first and second profiles, said fastener strip having perforations between said receipt portion and said first and second profiles.

5. The reclosable bag of claim 1 wherein said back panel extends from said bag outboard of said fastener strip, said back panel having holes therein outboard of said fastener strip for hanging on a wicket.

6. A reclosable bag comprising:

a front panel and a back panel, said back panel having an inside surface facing toward said front panel; and a fastener strip mounted on said inside surface of said back panel, said fastener strip having a first profile and a second profile, said fastener strip being foldable over said front panel to a position wherein said first profile cooperates with said second profile to close the bag with the front panel between the first and second profiles.

* * * * *